United States Patent [19]

Hautemont

[11] Patent Number: 4,936,076

[45] Date of Patent: Jun. 26, 1990

[54] METHOD FOR CHANGING LABELS AND TOPS APPLIED TO THERMOPLASTIC RECEPTACLES

[75] Inventor: Jean-Claude Hautemont, Gif-sur-Yvette, France

[73] Assignee: Etude et Realistation de Chaines Automatiques -ERCA, Les Ulis, France

[21] Appl. No.: 229,119

[22] PCT Filed: Nov. 13, 1987

[86] PCT No.: PCT/FR87/00451

§ 371 Date: Sep. 7, 1988

§ 102(e) Date: Sep. 7, 1988

[87] PCT Pub. No.: WO88/03502

PCT Pub. Date: May 19, 1988

[30] Foreign Application Priority Data

Nov. 13, 1986 [FR] France ..... 86 15824

[51] Int. Cl.[5] ..... B65B 47/10; B65B 57/00; B65B 41/12; B65B 41/18

[52] U.S. Cl. ..... 53/453; 53/51; 53/55; 53/503; 53/64; 53/559; 53/389; 156/506; 83/946

[58] Field of Search ..... 53/415, 453, 471, 478, 53/55, 51, 503, 64, 65, 66, 559, 389; 83/926 J; 156/506, 544

[56] References Cited

U.S. PATENT DOCUMENTS

| | | | |
|---|---|---|---|
| 3,757,619 | 9/1973 | Gianese | 53/64 X |
| 3,971,192 | 7/1976 | Soukup et al. | 53/559 |
| 4,017,247 | 4/1977 | Soukup et al. | 53/559 X |
| 4,018,028 | 4/1977 | Donnet | 53/559 X |
| 4,331,301 | 5/1982 | Martinez . | |
| 4,467,589 | 8/1984 | Van Maanen | 53/51 X |
| 4,541,221 | 9/1985 | Seragnoli | 53/55 X |
| 4,565,052 | 1/1986 | Hautemont | 53/559 X |
| 4,774,796 | 10/1988 | Aiuola et al. | 53/51 X |
| 4,800,705 | 1/1989 | Bodolay | 53/559 X |

*Primary Examiner*—Horace M. Culver

*Attorney, Agent, or Firm*—Mason, Fenwick & Lawrence

[57] ABSTRACT

A method of changing or replacing one liquid or semi-liquid product by another for insertion in a succession of thermoplastic receptacles bearing respective decorative and/or informative elements wherein, a minimum buffer volume is determined for a first product contained in a metering dispenser and in a buffer tank, the buffer volume corresponding to the sum of the portions of first product which remain to be inserted into the receptacles prior to the receptacles being replaced in a filling station zone by receptacles provided with different decorative elements. While the installation is in operation, a first master strip of the decorating station and/or a first strip of receptacle tops are cut transversely at distances from the filling zone which corresponds to the lengths of the first master strip and/or of the first strip of tops which will be consumed by the receptacles receiving the last portions of product from the minimum buffer volume of the first product.

26 Claims, 12 Drawing Sheets

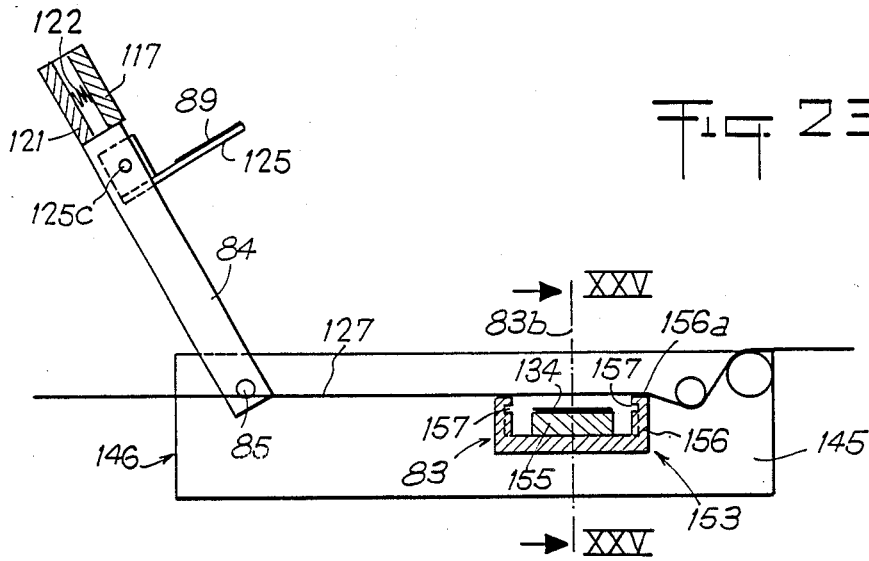
Fig. 23
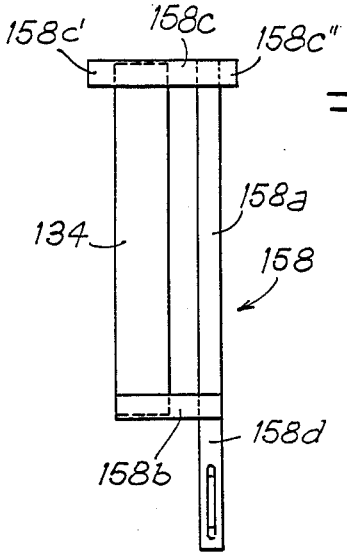
Fig. 24
Fig. 25
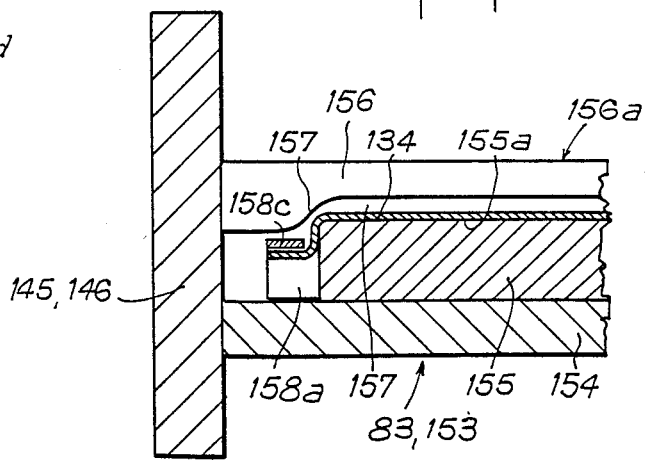

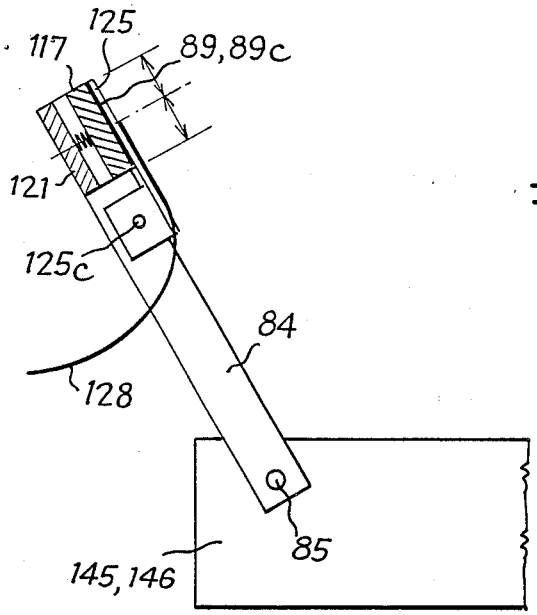
Fig. 26
Fig. 27
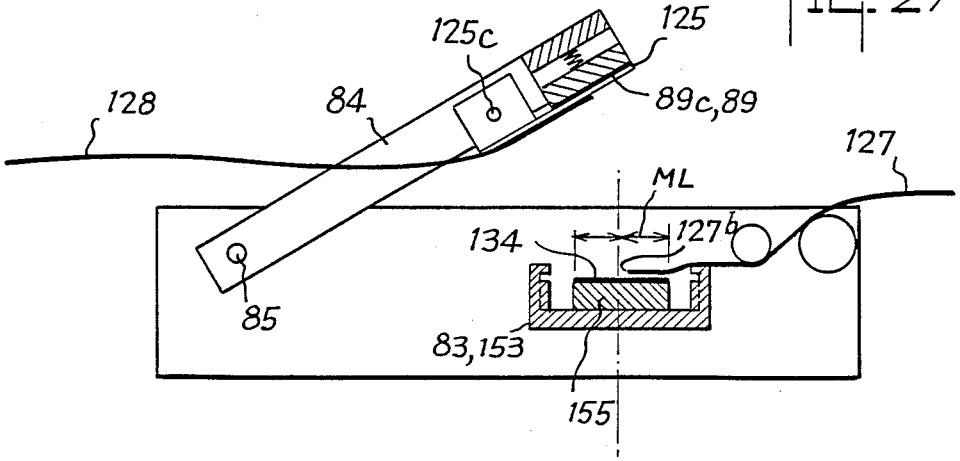
Fig. 28
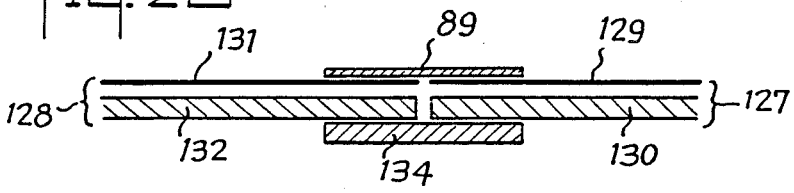

METHOD FOR CHANGING LABELS AND TOPS APPLIED TO THERMOPLASTIC RECEPTACLES

The present invention relates to a method of changing or replacing a liquid or semi-liquid product by another for insertion into a succession of thermoplastic receptacles bearing respective decorative and/or informative elements, the method being of the type wherein the decorative and/or informative elements to be fixed on the thermoplastic receptacles are changed when a first product for insertion into a first series of receptacles bearing respective first decorative and/or informative elements is replaced by a second product for insertion in a second series of receptacles bearing different decorative and/or informative elements, said method being implemented in a packaging installation of the type in which thermoplastic receptacles are formed in a thermoplastic strip, the receptacles are filled with a product, closed with respective tops, and the filled and closed receptacles are cut from said thermoplastic strip either in groups or individually.

In a first implementation of this type of prior method, the nature of the product is changed when the tank storing said product is empty, in which case the packaging installation is stopped after flushing out the remainder of the product with a buffer of water into the metering-dispenser, and washing all of the feed ducts and the inside of the metering-dispenser with water. The decoration elements are changed, as is the product in the storage tank, and also in the ducts and in the metering dispenser, prior to restarting thermoforming new receptacles and filling them with this other product and then closing said new receptacles provided with at least one decorative and/or figurative element taken from a different supply reel. In another implementation of the prior type of method, two storage tanks are provided, containing respective products of differing nature or taste, said tanks are both connected via parallel-connected ducts and individual stop valves to a common feed duct leading to a product metering-dispenser. The first product ceases to be taken from the first storage tank and the remainder of the product contained in the feed duct is urged towards and into the metering-dispenser by means of a buffer of water, the operation of the packaging installation is halted, the parallel-connected ducts, the common feed duct, and the metering-dispenser are washed with water, the reel(s) for storing decorative or informative strip(s) are replaced by other reel(s) for storing other decorative or informative strip(s) and the free end(s) thereof is/are inserted into the system for guiding and placing said strip(s) or elements taken from said strip(s) upon the receptacles, and the packaging installation is restarted prior to inserting the second product contained in the second storage tank into the common feed duct and into the metering-dispenser.

There exist several variants of this above-mentioned type of prior method.

The main drawbacks inherent to this type of method are lack of flexibility in operation, loss of product and of packaging and decorating materials, and loss of time when changing from one product to another and/or from one decoration or information material to another, given that the decoration and/or information material may apply equally well to the labels which cover at least a portion of the receptacle side walls, and to the tops which close said receptacles.

The object of the present invention is to avoid the above-mentioned drawbacks and to provide a method which allows the product being put into the receptacles to be changed simultaneously with changing the decorative and/or informative elements, without stopping operation of the packaging installation and practically without losing any product and/or packaging material, including any decorative and/or informative elements.

In a packaging installation of the type which comprises the following going from upstream to downstream in a station supporting a reel of thermoplastic strip from which the receptacles are to be formed: a heating station for raising the thermoplastic strip to its thermoforming temperature; a thermoforming station; a filling station including a metering dispenser for the product which is connected upstream to at least one product storage tank; a receptacle closing station associated with at least one reel upstream therefrom for a strip of tops for sealing to the edges of filled receptacles; a cutting station for separating receptacles in groups or individually from their connections with the thermoplastic strip; a pulling or advancing station for advancing the thermoplastic strip step-by-step; and, partially to one side and partially upstream or downstream from the thermoforming station, a station for decorating the sides of the receptacles and including at least one reel of a master strip from which individual decorative labels are cut; said object is achieved according to the invention due to the facts that a minimum buffer volume of the first product is determined, said volume being contained in the metering-dispenser, and in a buffer tank or in the ducts connecting said metering-dispenser to the buffer tank or to a source of first product, said buffer volume corresponding to the sum of portions of the first product still to be inserted in the receptacles prior to the receptacles being replaced in the filling station zone by receptacles provided with different decorative elements; that during operation of the installation, the first master strip of the decorating station and/or the first top strip is/are cut transversely at distances from the filling station corresponding to the length(s) of the first master strip and/or of the first top strip which will be consumed by the receptacles receiving the last portions of product from the minimum buffer volume of first product, and that immediately after the first master strip and/or the first top strip has/have been cut, the trailing end(s) of the cut length(s) of strip are connected to the leading end(s) respectively of a second master strip and/or of a second top strip, and a second product is inserted into the feed duct upstream from the metering-dispenser or from the mixer in such a manner as to cause said second product to replace said first product in the minimum buffer volume.

By virtue of this design, losses of product, of thermoplastic strip, of decorating master strip, and of top strip are considerably reduced, and the operation of the packaging installation is not interrupted.

The present invention also relates to a mechanism for splicing together two strips in an installation for packaging a liquid and/or semi-liquid product, the installation being of the type in which receptacles are thermoformed from a thermoplastic strip, the thermoformed receptacles are filled with a product, and then closed by heat-sealing their openings by means of a top strip. In some cases, this type of installation also includes a decoration device for hot-sticking decorative labels on the side walls of the receptacles while they are being thermoformed.

The thermoplastic strip, the top strip, and the master strip of labels are all stored in the form of reels, and when the corresponding reel is nearly empty or when the strip in question is to be replaced by another strip, the trailing end of the first strip is spliced to the leading end of another strip which may be identical or different relative to the first in appearance or nature, but which is preferably identical to the first in width and thickness, with the ends of the two strips to be spliced being cut at right angles relative to their longitudinal edges.

The present invention provides, more particularly, a mechanism for splicing together two strips the mechanism being of the type comprising a fixed lower support table intended to serve as a bearing surface for the two strip ends at the moment they are spliced together, a temporary support means for an adhesive tape extending transversely to the leading end of the second strip with a portion at least of the tape being stuck thereto, and an applicator lever disposed partially over the support table and having a bearing plate at its end opposite from its hinged end for the purpose of pressing the free adhesive face of said tape against the trailing end of the first strip, the mechanism also including a cutting unit for cutting the trailing end of said first strip at right angles.

A splicing mechanism of this type is described, for example, in French Pat. No. 2 073 133. In this case, the leading end of the second strip is held in a waiting position over the support table firstly by means of a series of fixed suction nozzles against which a portion of the uppermost face of the second strip is applied, and secondly, downstream from said nozzles, by means of an adhesive tape whose bottom face sticks firstly to the uppermost face of the leading end of the second strip and secondly to the adhesive tape support provided slightly downstream and above said support table. The trailing end of the adhesive tape support forms a transverse counterblade which extends parallel to the trailing and leading ends of the first and second strips respectively and which cooperates with a transverse knife blade provided on a transverse edge of the bearing plate of the applicator lever. Access to this splicing mechanism is difficult while the first strip is advancing step-by-step. In addition, after the adhesive tape has been cut, the leading end of the second strip is neither retained nor is it guided for the purpose of positioning it exactly and accurately relative to the trailing end of the first strip. Further, the free cut-off portion of the adhesive tape may roll up and make it difficult or impossible to stick it on the trailing end of the first strip.

The object of the present invention is to avoid the above-mentioned drawbacks and to provide a splicing mechanism of the same type, but which is easily accessible during step-by-step advance of the first strip and which is also simple in design.

This object is achieved by the invention due to the facts that the temporary support means of the adhesive tape are provided on the free end of the applicator lever, that the applicator lever is suitable for being tilted from its waiting position over the support table towards a loading position situation outside the path of the first strip and at a location which is distant from the support table, and that the cutting unit for cutting the first strip has a transverse cutting plane provided upstream from the support table at a distance from the transverse mid-plane of said table which is equal to at least one full advance step of said first strip or to a multiple of full steps, minus one half the width of the adhesive tape, where appropriate.

By virtue of this design, the second strip and the adhesive tape may be prepared for splicing in an easily accessible loading position and the leading end of the second strip and the adhesive tape are maintained and guided with accuracy until they are assembled with the trailing end of the first tape on the support table.

The subject matter of the invention will be understood even better from the following description of an embodiment of the invention together with several variants both of the method and of the splicing mechanism, said description being made with reference to the accompanying drawings, in which.

Figure 12:
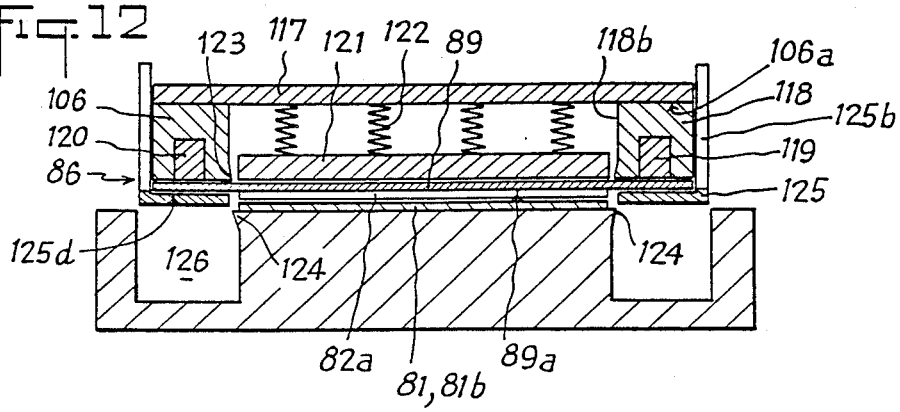
Figure 13:
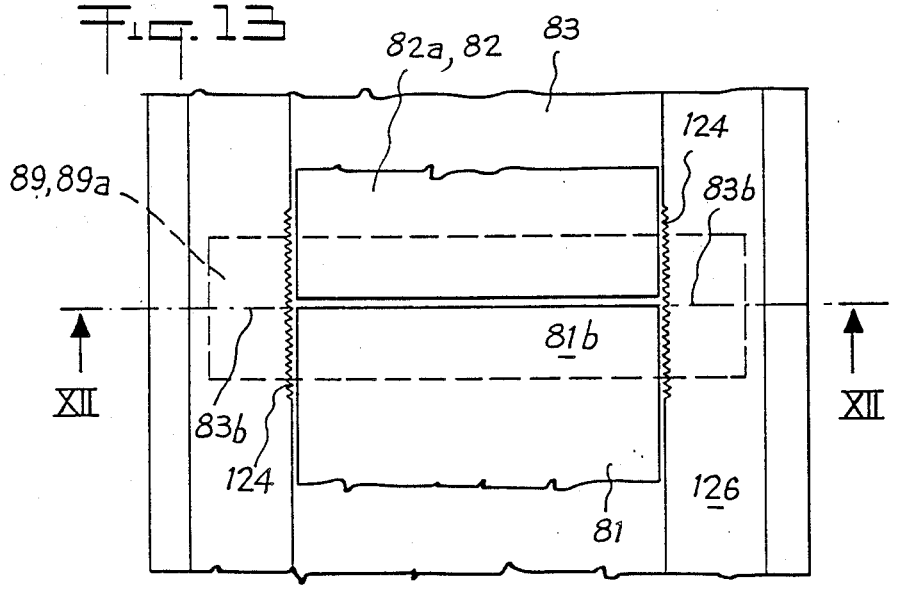
Figure 14:
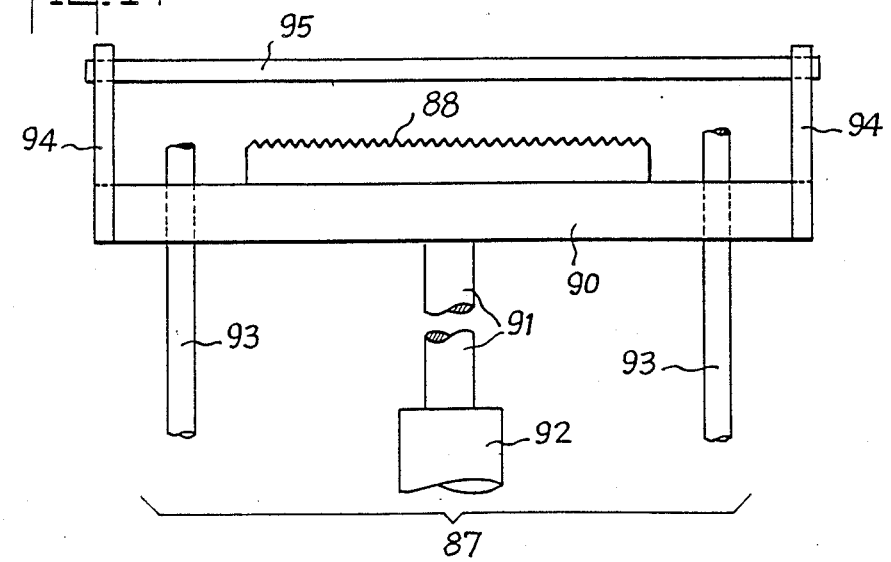
Figure 15:
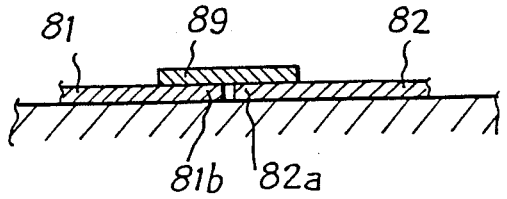
Figure 16:
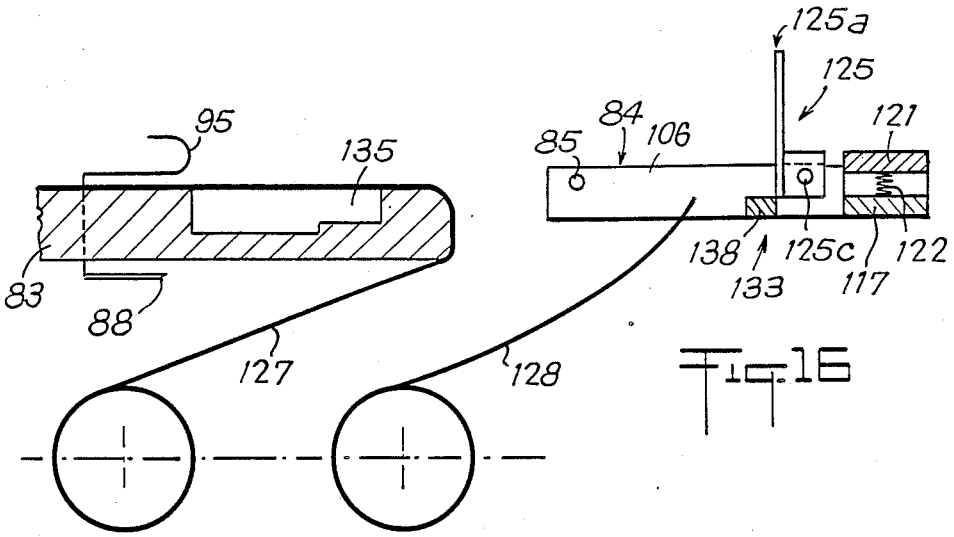
Figure 17:
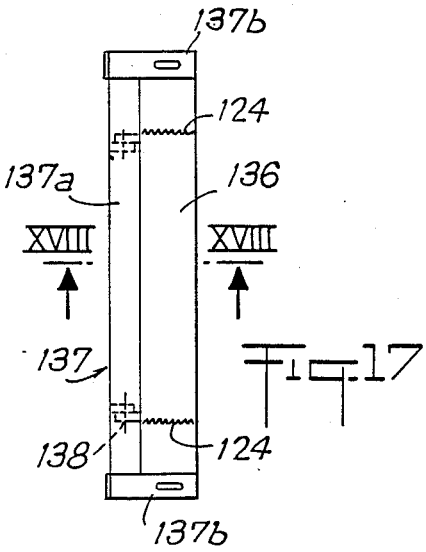
Figure 18:
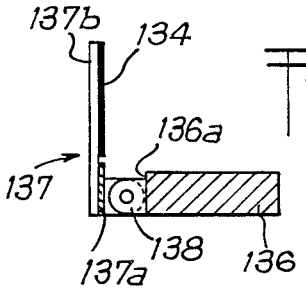
Figure 19:
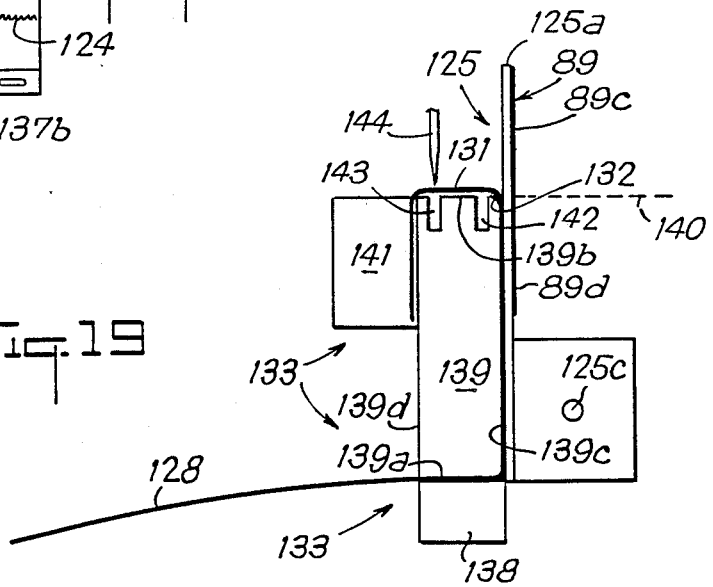
Figure 20:
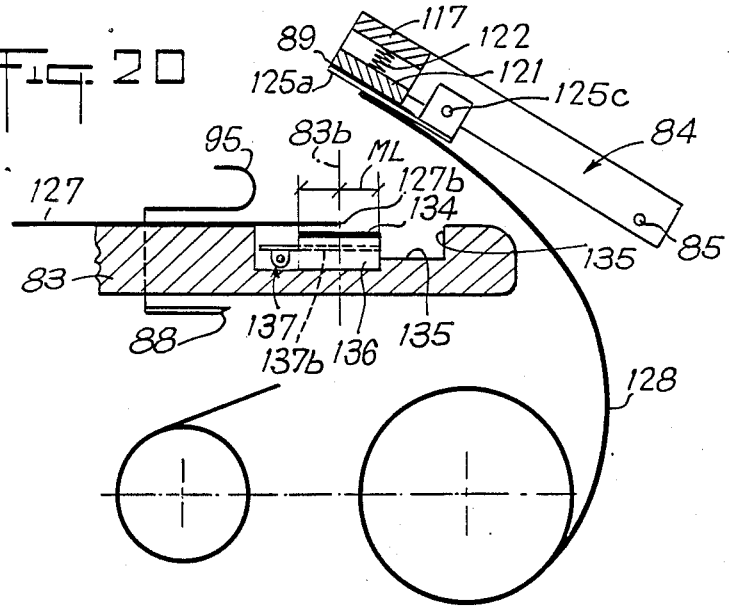
Figure 21:
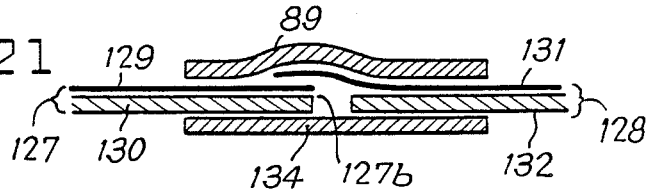
Figure 22:
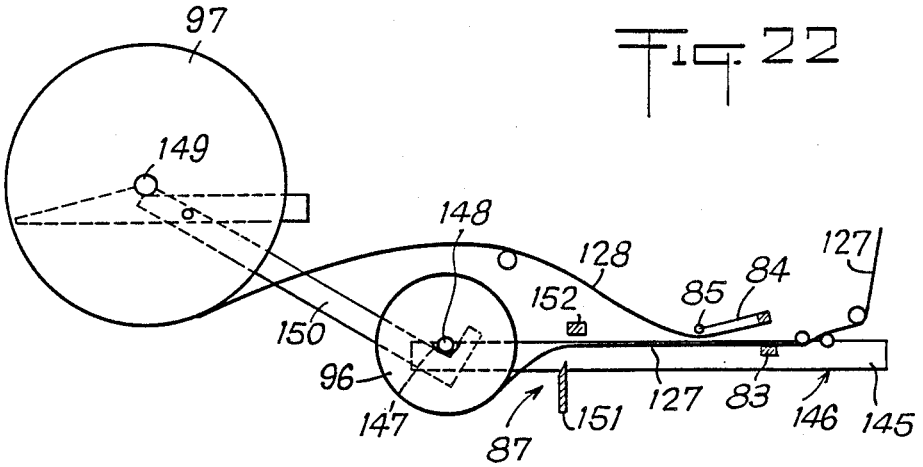

FIG. 12 is a vertical cross-section through the front portion of the applicator lever and the support table immediately prior to the two strips being spliced together by applying adhesive tape to the trailing end of the first strip located on said support table, said vertical section passing through a middle vertical transverse plane (line XII—XII in FIG. 13) of the support table, and being shown in front elevation view;

FIG. 13 is a plan view of the support table in the zone for splicing together two strips on either side of the middle vertical transverse plane XII—XII of said table;

FIG. 14 is a plan view of the unit for cutting the first strip and for holding off the second strip;

FIG. 15 is a longitudinal section through the splicing zone between two strips, shown in elevation view with splicing being performed using the second embodiment of the mechanism;

FIG. 16 is a vertical longitudinal section through a third embodiment of the splicing mechanism, and shown in diagrammatic elevation view;

FIG. 17 is a plan view of an anvil with a hinged support bow and for insertion in the support table;

FIG. 18 is a longitudinal section through the anvil of plane XVIII—XVIII of FIG. 17, and shown in elevation view;

FIG. 19 is a diagrammatic elevation view of auxiliary means for preparing the positioning of the front end of the second strip which is in the form of a composite strip comprising two films that can be peeled apart;

FIG. 20 is a diagrammatic elevation view of the splicing mechanism in a waiting position immediately prior to splicing together two composite strips;

FIG. 21 is a vertical longitudinal section through the splicing zone of two composite strips which are connected by means of the third embodiment, and shown in elevation view;

FIG. 22 is a diagrammatic elevation view of a fourth embodiment of the splicing mechanism;

FIG. 23 is a longitudinal vertical section through said fourth embodiment, and shown in elevation view;

FIG. 24 is a plan view of a removable support bow associated with the anvil of the support table;

FIG. 25 is a fragmentary vertical cross-section through the support table on line XXV—XXV of FIG. 23, and shown in front elevation view on the splicing plane or the vertical transverse midplane through the support table on line XXV—XXV of FIG. 23;

FIG. 26 is a diagram showing the applicator lever in its loading position; FIG. 27 is a longitudinal vertical section through the fourth embodiment shown in diagrammatic elevation view and showing the applicator lever in the waiting-to-splice position above the support table; and FIG. 28 is a vertical longitudinal section through the splicing zone between two composite strips, and shown in elevation view.

The packaging installation in which the method of the invention can be used is of the type described, for example, by French patent No. 2 034 915 and, in outline, it comprises the following going from an upstream end to a downstream end in the direction 1 of travel of a thermoplastic strip 2: a station for supporting a reel 3 of thermoplastic strip in which successive rows of receptacles (not shown) are to be formed; a heating station (not shown) serving to raise the thermoplastic strip 2 to its thermoforming temperature; a thermoforming station 4 in which successive rows of receptacles are formed from the thermoplastic strip; a filling station 5 including a metering dispenser 6 for the product; a closing station 7 for sealing the receptacles and associated upstream therefrom with a reel 8 for storing a strip of tops 9; a receptacle cutting-out station 10 in which the receptacles are cut out from the thermoplastic strip 2, either in groups of several receptacles or else individually; a station (not shown) for drawing or advancing the thermoplastic strip 2 and located partially to one side and partially upstream or downstream from the thermoforming station 4; and a station 11 for decorating the sides of the receptacles.

The decorating station 11, as described for example in greater detail in French Pat. No. 2 034 915, comprises at least one reel 12 for storing a master decoration strip 13 which, is cut longitudinally into individual strips 15 in a slicing mechanism 14, with said individual strips 15 being inserted into a pre-winding block 16 where they are cut up transversely into labels which are then transferred into the forming chambers 4*a* of the mold block in the thermoforming station 4.

The strip of tops g passes over several deflector rolls 17, 18 and is brought over the openings of the receptacles prior to their entering into the closing station 7.

The metering-dispenser 6, as described, for example, in French Pat. No. 2 067 983, comprises as many metering chambers as the mold block has forming chambers 4*a*. The inlets of these metering chambers are connected via a common feed duct 19 and parallel-connected ducts 20 and 21 each including a respective stop valve 22 or 23 to the bottoms of storage tanks 24 and 25 for storing respective products A and B which differ in nature and/or taste and/or structure.

Each of the storage tanks 24 and 25 includes a minimum level probe 26 and a maximum level probe 27 and is itself supplied with the corresponding product A or B via a general duct 28 or 29 provided with a stop valve 30 or 31. It should be observed that inside the enclosure defined by each of the storage tanks 24 and 25, which in reality acts as a buffer volume, the pressure is kept permanently high in order to prevent polluted air from entering and also serving to urge the product towards the metering-dispenser 6. Each of the parallel-connected ducts 20 and 21 is connected between its stop valve 22 or 23 and its buffer tank 24 or 25 to a safety and emptying valve 32 or 33, with both stop valves 22 and 23 being disposed very close to the upstream end of the common duct 19.

The reel 12 for storing the master strip 13 is associated with another reel 34 for storing a second master strip 35, and between the longitudinal slicing mechanism 14 and the storage reels 12 and 34 there is a splicing mechanism 36 in which the first master strip 13 is cut transversely and the trailing end of the downstream length of the first master strip 31 is attached by means of an adhesive tape to the adjacent leading end of the second master strip 35. This splicing mechanism 36 generally includes a transverse knife 37 and a support table 38 provided with a slot for passing the knife 37 and serving as a backing at the moment when the trailing end of the length cut off from the first master strip 13 is spliced to the leading end of the second master strip 35.

Similarly, the reel 8 for storing tops 9 is associated with another reel 39 for storing a second strip of tops 40, and between the uppermost deflector roll 17 and the reels 8 and 39 for storing the strips of tops 9 and 40, there is another splicing mechanism 41 which, in the same manner as the splicing mechanism 36, comprises a lower support table 42 for the strips 8 and 39 and an upper transverse knife 43 which, during the operation of cutting off a length of the first strip 8 of tops penetrates into a transverse slot provided in the lower support table 42 provided beneath a portion of the horizontal path of the top strips 8 and 39. In this splicing mechanism 41, the leading end of the second top strip 40 is not necessarily placed end-to-end with the trailing end of the length cut off from the first top strip 8, but may alternatively be disposed on said trailing end prior to being attached thereto by means of a transverse adhesive tape.

The minimum and maximum level probes 26 and 27 of the buffer tanks 24 and 25 respectively control the opening and the closing of the corresponding stop valves 30 and 31 so that inside said buffer tanks the volumes of the products A or B vary between the minimum level and the maximum level.

In a packaging installation, the number X of steps through which the thermoplastic strip 2 advances between the transverse midplane PM of the thermoforming station 4 and the transverse midplane PD of the ejection nozzles 6*a* of the metering dispenser 6 is known. The number Y of advance steps between the knife 37 of the mechanism 36 for splicing the master strips 13 and 35 and the pre-winding and transverse cutting block 16 is also known, as is the number Z of advance steps between the transverse midplane PD of the ejection nozzles 6a and the transverse midplane PS of the closing station 7 in which a top strip 9 or 40 is sealed to the top edges of the thermoformed receptacles while they are still attached to the thermoplastic strip 2.

It is recalled that the master strip 13 or 35 advances by a step whose size is equal to the length of a label which will be cut off transversely from an individual strip 15 and then transferred into one of the forming chambers 4a of the mold block in the thermoforming station 4, and that the thermoplastic strip 2 and the top strips 9 or 40 advance by a step size whose length PL is equal to the width of the mold block containing said chambers 4a. The different advance steps of the thermoplastic strip 2 and of the top strip 9 or 40 are performed simultaneously, whereas the master strip 13 or 35 is advanced independently but in such a manner as to ensure that one advance step of the thermoplastic strip 2 corresponds to one advance step of the master strip 13 or 35.

If the number of steps X is equal to 6.5 and the number Y is equal to 17, then it is arranged that when the level of the product A in buffer volume 24 is at its minimum level, the minimum volume VM of the product A contained in the first buffer tank 24, in the ducts 19 and 20 connecting said tank 24 to the metering dispenser 6, and also inside said metering-dispenser 6 is equal to the sum of portions PA of product A which corresponds to the number of receptacles N that are thermoformed during a number of steps equal to the sum $(X+Y)=23.5$ steps.

If it is desired to manufacture a determined number ND of receptacles filled with product A and decorated accordingly, then the two master strips 13 and 35 are spliced together by the splicing mechanism 36 and the feed to buffer tank 24 via stop valve 30 is switched off when the number of receptacles filled at the location of the metering-dispenser 6 is equal to (ND - N). The remainder N of receptacles will be filled with the product A after the master strips 13 and 35 have been spliced together (which occurs between two advance steps of the first master strip 13). In this case, the product A is expelled from the buffer tank 24 either under the effect of gravity, or else under the effect of the excess pressure occupying said first buffer tank, and when the end of the product A has arrived at stop valve 22 in parallel-connected duct 20, said valve 22 is closed and stop valve 23 in parallel-connected duct 21 is opened, thus connecting to the second buffer tank 25 which contains the product B and in which there is also excess pressure.

The end of product A is thus expelled by the beginning of product B along the common duct 19 and through the metering dispenser 6 into the receptacles which will start having labels coming from the second master strip 35 and corresponding to product B at the time the product B reaches them.

A mismatch may occur in a few transverse rows of receptacles between the contents of receptacles and the labels applied thereto if product A is not at its minimum level in the buffer tank 24 when the stop valve 30 is closed, but is at a level lying between its minimum level and its maximum level. However, this mismatch between the product and the labels on the receptacles can be greatly reduced when there is only a small difference between the extreme product levels in said buffer tank 24.

If it is desired to provide receptacles filled with new product B, which receptacles have tops bearing decorations or inscriptions corresponding to the new product B contained therein, the splicing mechanism 41 for the strips of tops 9 and 40, and more precisely its transverse knife 43, is disposed at a distance DS from the transverse midplane PS of the closing station 7 which is not less than the sum $(X+Y+Z)$ of advance steps PL of the top strip 9 or 40 or of the thermoplastic strip 2. If the distance DS equals $PL.(X+Y+Z)$, then the top strips 9 and 40 should be spliced at the same time as the master strips 13 and 35, and if the distance DS along the top strip 9 or 40 is greater than $PL.(X+Y+Z)$, and naturally equal to an integer number of advance steps PL, then the top strips 9 and 40 need to be spliced earlier than the master strips 13 and 35 at an instant suitable for allowing the top strip 9 to perform the appropriate number of steps exceeding the value $PL.(X+Y+Z)$.

If the distance DL is less than the value PL $(X+Y+Z)$, then the top strips 9 and 40 are spliced after the master strips 13 and 35 at an instant such that the top strip has already advanced by the appropriate number of steps for the sum of said number of steps and the distance DL to be equal to the value $PL.(X+Y+Z)$.

It will easily be understood that this new method makes it possible to rapidly replace one filling product by another and to adapt the decoration of the receptacles practically simultaneously with the new product being inserted therein, regardless of whether the decoration is in the form of labels for application to the sides of the receptacles and/or whether the decoration is in the form of tops on which the decoration or the inscription changes compared with the earlier tops.

Figure 1:
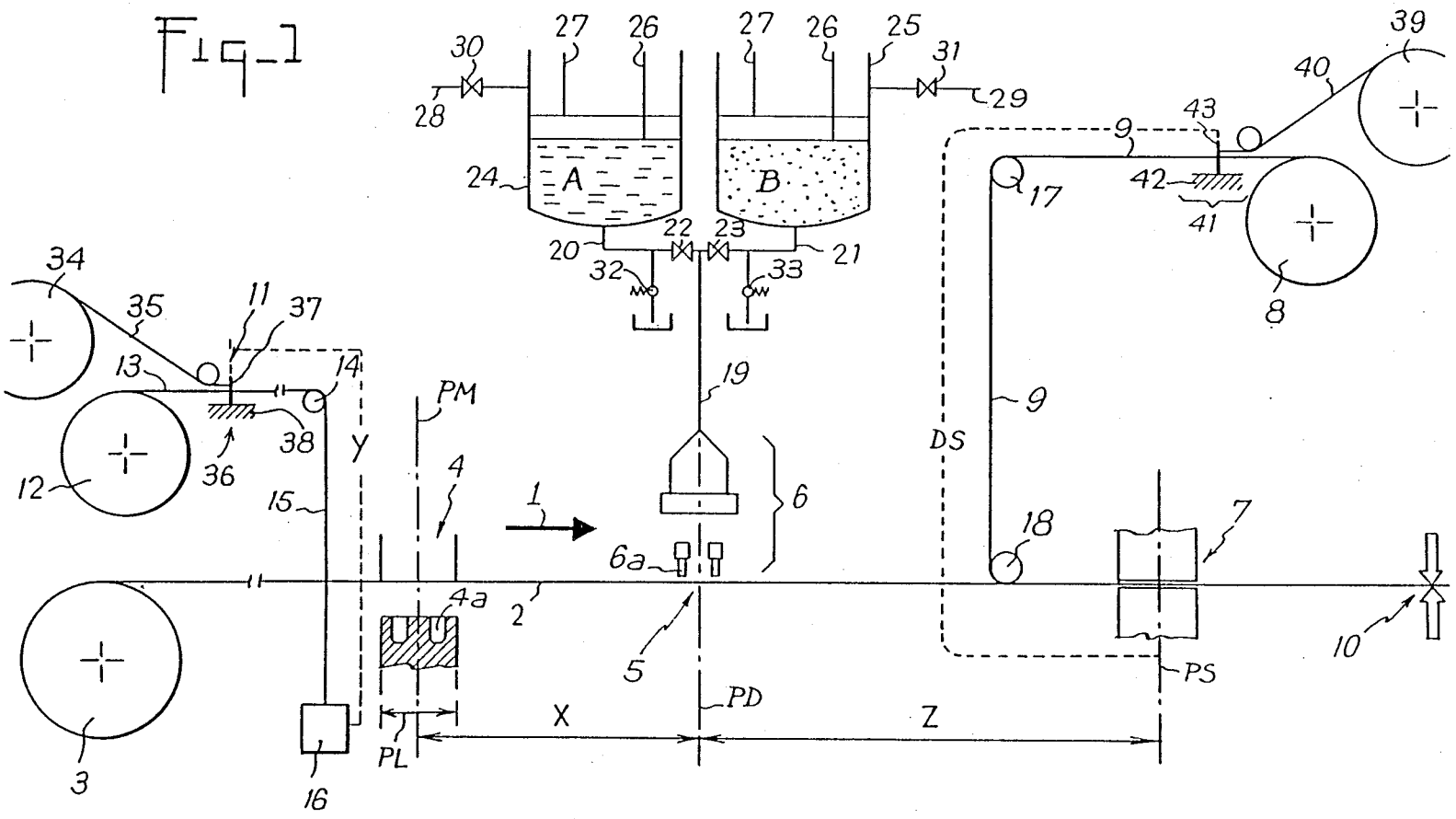
FIG. 1 is a diagrammatic view of a packaging installation.
Figure 2:
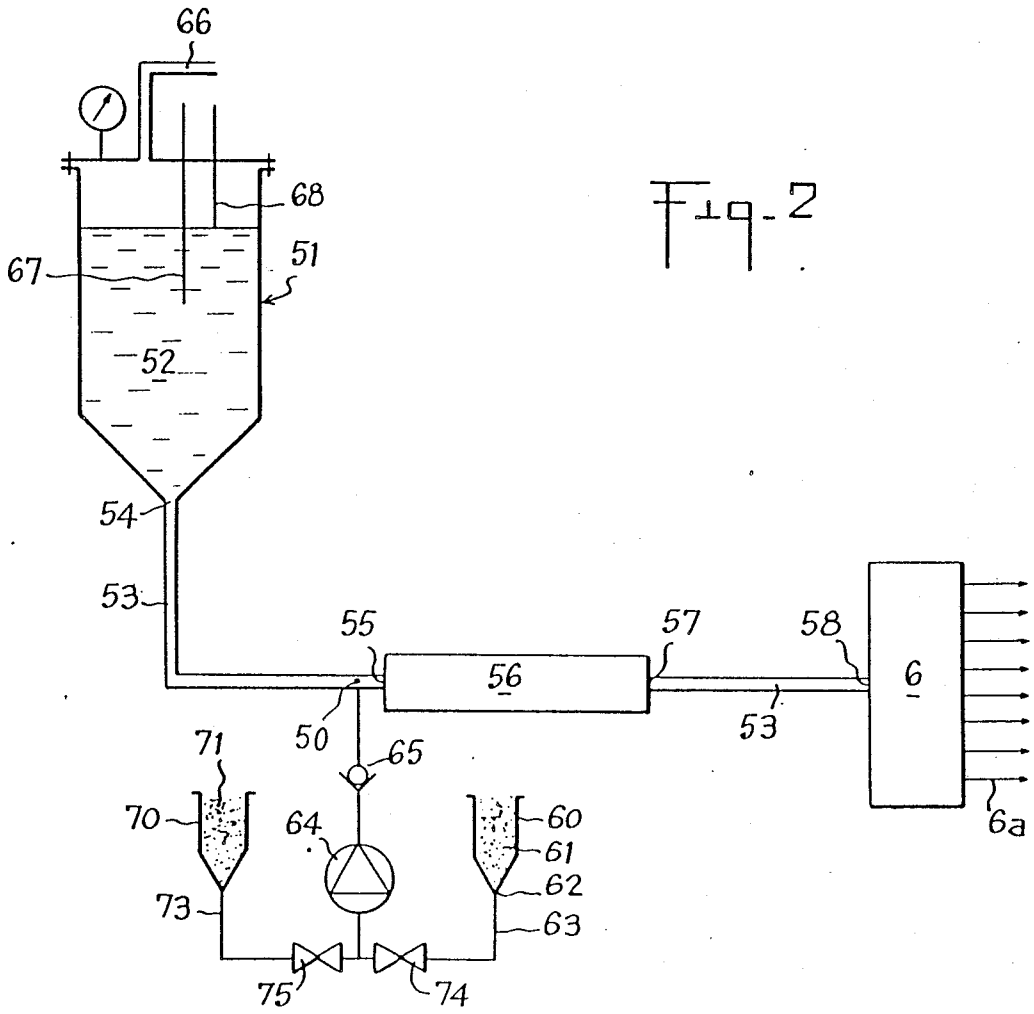
FIG. 2 is a fragmentary diagram of a variant of the FIG. 1 installation.

As can be seen in FIG. 2, an installation for filling receptacles with a product includes a first storage tank 51 containing a basic product 52 such as a white yogurt which may be stirred or not, or a fresh cottage cheese or milk to be gelled, and a general feed duct 53 which connects the bottom outlet of the tank 51 to the inlet 55 of a static or dynamic mixer 56, with the outlet 57 from the mixer being connected to the inlet 58 to the metering chambers of a metering-dispenser 6. The installation also includes at least one second storage tank 60 containing an additive 61 such as jam or flavoring and whose outlet 62 is connected via a secondary or parallel-connected duct 63 to a positive displacement pump 64 and from the outlet of the pump via a non-return valve 65 to the inlet 55 of the mixer 56 where said secondary duct 63 opens out into the main duct 53. The first storage tank 51 is connected at its uppermost end to a source of preferably sterile gas under pressure via a duct 66, and, where applicable, it includes a minimum level probe 67 and a maximum level probe 68 which control, for example, the supply of basic product 52 to said tank 51.

The outlet from the metering-dispenser 6 has a plurality of ejection nozzles 6a through which metered quantities of product mixture are inserted into corresponding receptacles (not shown).

As mentioned above, the metering-dispenser 6 is of conventional structure, in particular as described in French Pat. No. 2 067 983, and is not described below. The positive displacement pump 64 is also of conventional type and is switched on intermittently solely during the suction stroke of the metering-dispenser 6. To this end, the power supply to the electric motor of the pump 64 is advantageously under the control of end-of-stroke switches associated, for example, with one of the piston rods in the metering-dispenser 6.

In order to be able to change the composition of the product mixture quickly, it is advantageous to associate the positive displacement pump 64 (or any other technically equivalent device) with at least one additional storage tank 70 containing an additive 71 whose nature or flavor or taste is different from that of the first additive, and whose base 72 is connected via a secondary or parallel connected duct 73 to the pump 64. In order to avoid unwanted mixing between the additives 61 and 71, a stop valve 74 or 75 is interposed in each of the secondary ducts 63 and 73 between the outlet from each of the two tanks 60 and 70 and the inlet to the pump 64.

As in the preceding example, precautions are taken in analogous manner to ensure that the minimum volume VM of a first product mixture (for example basic product 52 and additive 61) contained in the mixer 56, in the length of main duct 53 between the mixer 56 and the metering-dispenser 6, and in said metering dispenser 6, corresponds to the mathematical product of first product mixture portions PA multiplied by the number N of receptacles which are thermo-formed during a number of advance steps of the thermoplastic strip 2 equal to the sum (X+Y) where X and Y have the same meanings as above.

In order to determine the instant at which the master strips are spliced, the procedure in this case is extremely simple since under the above-mentioned conditions for VM, the additive 61 is replaced by the other additive 71 by closing valve 74 and opening valve 75 while simultaneously splicing the master strips 13 and 35. As for splicing the top strips g and 40, the same considerations apply as in the preceding example.

It is easy to understand how one or more product mixtures are made:

The basic product 52 flows into the main duct 53 either under the effect of gravity if it is sufficiently liquid or else under the effect of thrust from the excess pressure existing in the tank 51. This flow towards the mixer 56 takes place by units of volume which correspond to the volume of product mixture sucked into the metering-dispenser 6 during a suction stroke into all of its chambers During each advance step of product or product mixture along the main duct 53, corresponding to the suction period of the metering-dispenser 6, a quantity of additive 61 or 71 is injected into the inlet 55 of the mixer 56, said quantity corresponding to the volume of additive required in the volume of product mixture dispensed by all of the chambers of the metering-dispenser 6, for example. The basic product 52 and the additive 61 are mixed in the mixer 56 and the mixture is then sucked and/or thrust in predetermined quantities towards the metering chambers of the metering-dispenser 6.

Naturally, when the first product is constituted by a mixture of a basic product 56 and an additive 61 or 71, the minimum buffer volume VM may be constituted by the volume of the product contained in the ducts or chambers lying between the outlet from the metering-dispenser 6 (the ejector nozzles 6(*a*) and the point 50 where the additive 61 or 71 is injected into the basic product 52 contained in the main duct 53, together with the volume of product contained in the mixer 56 and in the buffer tank 24. If for one reason or another the mixer 56 and the buffer tank 24 are omitted, the minimum buffer volume VM of the first product is then constituted by the internal volume of the metering-dispenser and the internal volume of the ducts such as 19 and 53 lying between said metering-dispenser 6 and the point 50 at which an additive 61 or 71 is injected into the basic product 52 in the main duct 53.

Figure 3:
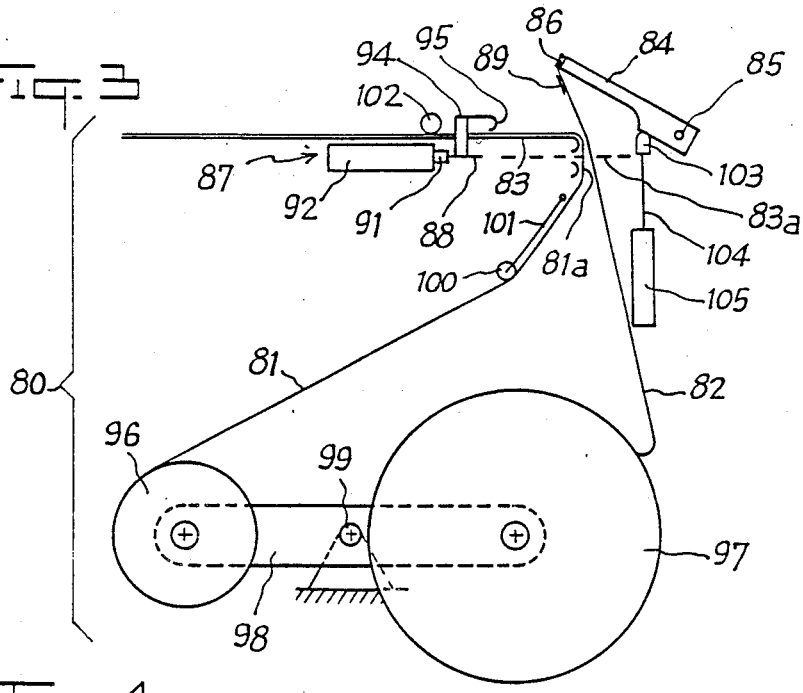
FIG. 3 is a diagrammatic side view in elevation of a first embodiment of the splicing mechanism.
Figure 4:
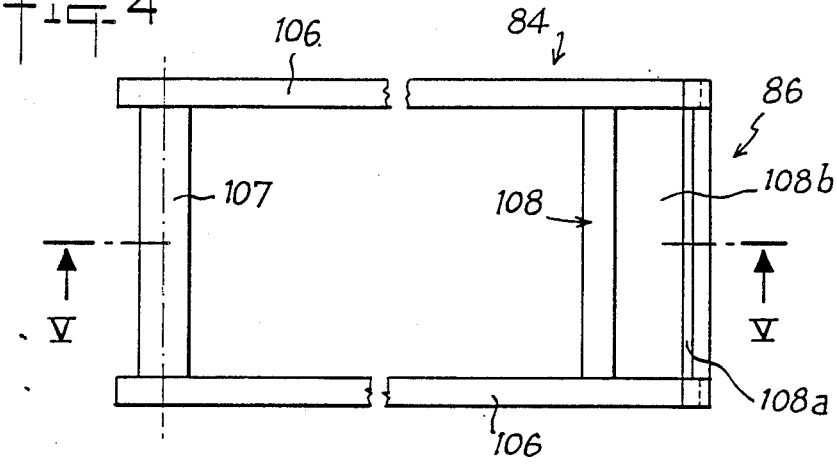
FIG. 4 is a plan view of the applicator lever in the loading position, said lever forming a part of the FIG. 3 mechanism.
Figure 5:
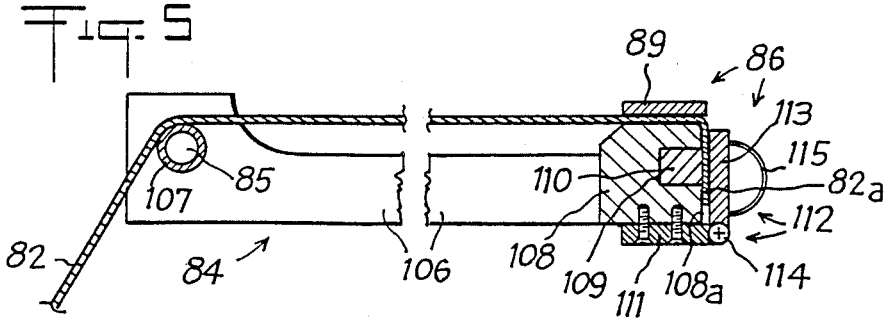
FIG. 5 is a vertical longitudinal section on plane V—V of FIG. 4 through the applicator lever, and shown in elevation side, view.
Figure 6:
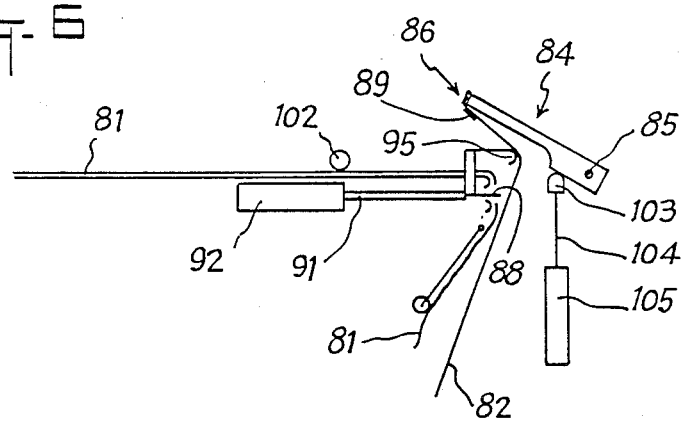
FIGS. 6 to 8 are diagrammatic side views showing various operating stages or positions of the FIG. 1 splicing mechanism.
Figure 7:
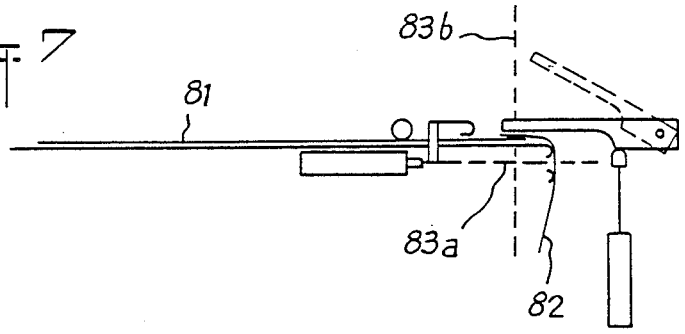
Figure 8:
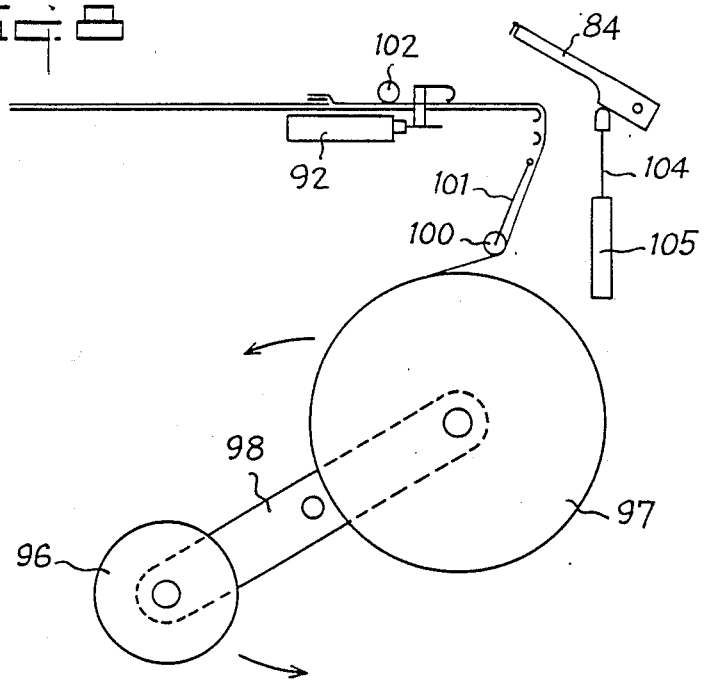
Figure 9:
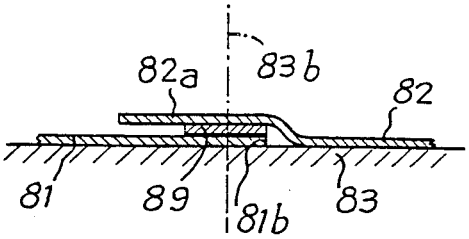
FIG. 9 is a longitudinal section through the splicing zone of two strips spliced together by means of the first embodiment, and shown in side view.

As shown in FIGS. 3 to 8, the first embodiment of the mechanism for splicing two strips 81 and 82 comprises a lower support table 83 installed at a fixed station on the horizontal path of the first strip 81, an applicator lever 84 having one end hinged about a horizontal shaft 85 upstream from said table 83 and whose other end includes temporary support means 86 for a transverse adhesive tape 89 and is capable on rocking up and down and of being applied against said table 83. In the waiting position as shown in FIG. 3, the front or downstream end of the applicator lever 84 is situated above the support table 83, whereas the upstream end and the hinge axis 85 of said lever 84 are situated at a certain distance and separate from said table 83. A cutting unit 87 is provided beneath the table 83 and has a transverse cutting blade 88 suitable for cutting a portion 81*a* of the first strip 81 at right angles, said portion 81*a* being situated on a length of vertical path of said first strip 81. As can be seen in FIG. 14, said cutting blade 88 is mounted in front of a transverse guide bar 90 whose center is fixed to the front end of a rod 91 of a control actuator 92 and whose side portions are slidable in horizontal guides 93 extending perpendicularly to the length of vertical path of the first strip 81. The side ends of the guide bar 90 are provided with respective vertical plates 94 in the form of upsidedown L-shapes having their vertical webs fixed to said bar 90 and their horizontal webs located at a level which is slightly higher than the table 83. The upstream free ends of the horizontal webs of the two plates 94, upstream as defined by the table 83, carry a transverse hold-off tube 95 which, in a plan view, is to be found upstream from the cutting blade 88, and which serves to keep the external portion of the second strip 82 fixed to the applicator lever 84 (see FIG. 6) away from said blade when the first strip 81 is being cut. The two strips 81 and 82 are paid out successively from respective storage reels 96 and 97 whose shafts are mounted on the ends of a support magazine 98 which is capable of pivoting about its own axis 99 while replacing one strip 88 by another 82. Between the storage reel 96 or 97 and the table 83, the strip currently being used, e.g. 81, is subjected to the action of a tensioning roll 100 mounted on the bottom end of a rocker 101, and downstream from the table 83, said strip is subjected to the action of a pair of traction rolls (of which only the roll 102 is shown in order to clarify the drawing). The upstream half of the applicator lever 84 is supported by a transverse bar 103 whose center is fixed to the free end of the rod 104 of a vertical actuator 105 and against which said lever 84 rests downstream from its hinge 85 such that when said rod 104 is extended said lever 84 occupies its waiting position in which it is ready to apply the leading end of the second strip 82 to the trailing end 81*b* cut from the first strip 81 at the moment when said trailing end is in position on the downstream half of the support table 83. The lever 84 is free to tilt (anti-clockwise as shown in FIGS. 3, 6, and 7) as soon as the bar 103 and its control rod 104 are lowered suddenly and quickly.

FIGS. 4 and 5 show one embodiment of the structure of the applicator lever 84 together with the temporary support means 86. In these two FIGS. 4 and 5, the lever 84 is shown in its loading position analogous to that shown in FIG. 10 and in which it is completely separate from the support table 83 and, in this particular case, is in a horizontal position in alignment with said table 83, and its face which is normally its bottom face is turned upwardly. The applicator lever 84 comprises two side bars 106 extending in vertical planes parallel to the longitudinal edges of the strips 81 and 82 and interconnected at their ends, firstly at the hinge axis 85, e.g. by means of a connection tube 107, and secondly at the front or downstream end by means of a cross-bar 108 having a housing 109 provided in its front face 108*a* for receiving a permanent bar magnet 110 which is glued in said housing 109. The uppermost face 108*b* (at the bottom in FIG. 5) of the cross-bar 108 is fixed to the fixed plate 111 of a metal hinge 112, made of steel for example, whose moving plate 113 is pivotable about the hinge pin 114 and suitable for being pressed flat against the front face 108*a* of said cross-bar 108, and since it is attracted by the permanent magnet 110, it is suitable for keeping the vertical front end 82*a* of the second strip 82 clamped between itself and the front face 108*a* of said cross-bar 108. The free outside face of the moving plate 113 of the hinge 112 is provided with a handle 115. The non-clamped portion of the end of the second strip 82 is folded towards the hinge axis and passes over the bottom horizontal face 108*b* of the cross-bar 108, the connection tube 107 (see FIG. 5), and the cross-bar 103 (see FIG. 10).

In this case, the bottom horizontal face 108*b* (uppermost in FIG. 5) of the cross-bar 108 serve as a bearing face for the end portion 82*a* of the second strip 82, which end portion 82*a* receives a double-sided adhesive tape 89 level with the bottom face (uppermost face in FIG. 5) and extending along a length which is not more than the width of the second strip 82.

It will readily be understood that in this first embodiment of the splicing mechanism, the temporary support means 86 for the adhesive tape 89 comprises the following elements taken together the front face 108*a* of the cross-bar 108; the permanent magnet 110; the metal hinge 112; and the end portion 82*a* of the second strip 82; which end portion 82*a* is releasably clamped against the front face 108*a* of the cross-bar 108 on which said adhesive tape 89 is stuck.

After pivoting the applicator lever 84 and the leading end 82*a* of the second strip 82 (anti-clockwise) towards the waiting position (see FIG. 3), the second strip 82 is ready to be spliced to the trailing end 81*b* of the first strip 81.

For this purpose, the trailing end 81*b* of the first strip 81 is cut in the horizontal cutting plane 83*a* of the table 83 by means of the cutting blade 88 while keeping the second strip 82 away from the first strip 81 in the vicinity of said blade 88 by means of the hold-off tube 95 (see FIG. 6) and, after the cutting blade 88 and the hold-off tube 95 have been retracted to their rest positions (see FIGS. 3 and 7), and after the first strip 81 has been advanced by at least one step or an integer multiple of advance steps until the trailing cut end 81*b* of said strip 81 is located on the support table 83 in the region around the transverse vertical midplane 83*b* therethrough, the applicator lever 84 is tilted downwardly and its downstream end then falls freely onto the support table 83 taking the leading end 82*a* of the second strip 82 together with the adhesive tape 89 with it as it falls, and applying said tape against the trailing end 81*b* of the first strip 81, thus splicing the two strips 81 and 82 (FIG. 7). It should be observed that the length of the travel of the cut end 81*b* of the first strip 81 between the horizontal cutting plane 83*a* and the vertical midplane 83*b* of the table 83 is equal to not less than one entire advance step of the first strip 81 or to a multiple of entire advance steps minus one-half the width of the adhesive tape 89. The distance between the front end 108*a* of the lever 84 and its hinge 85 is selected in such a manner that the bearing face 108*b* of said lever 84 falls onto the table 83 in substantially equal portions on either side of the vertical midplane 83*b* of the table. Once splicing has been achieved, the leading end 82*a* of the second strip 82 escapes from being clamped between the hinge plate 113 and the cross-bar 108 as soon as the lever 84 is raised again and/or as soon as the two spliced-together strips 81 and 82 are advanced through another step. After the two strips 81 and 82 have been sliced together, their support magazine 98 is pivoted anti-clockwise in order to bring the second reel 97 into the position occupied previously by the first reel 96 and in order to make it possible to prepare for a subsequent splicing cycle with the reels 96 and 97 in the position shown in FIG. 3.

A second embodiment of the splicing mechanism is shown in FIGS. 10 to 14 and serves to splice the two juxtaposed ends of two strips 81 and 82 in the manner shown in FIG. 15.

Figure 10:
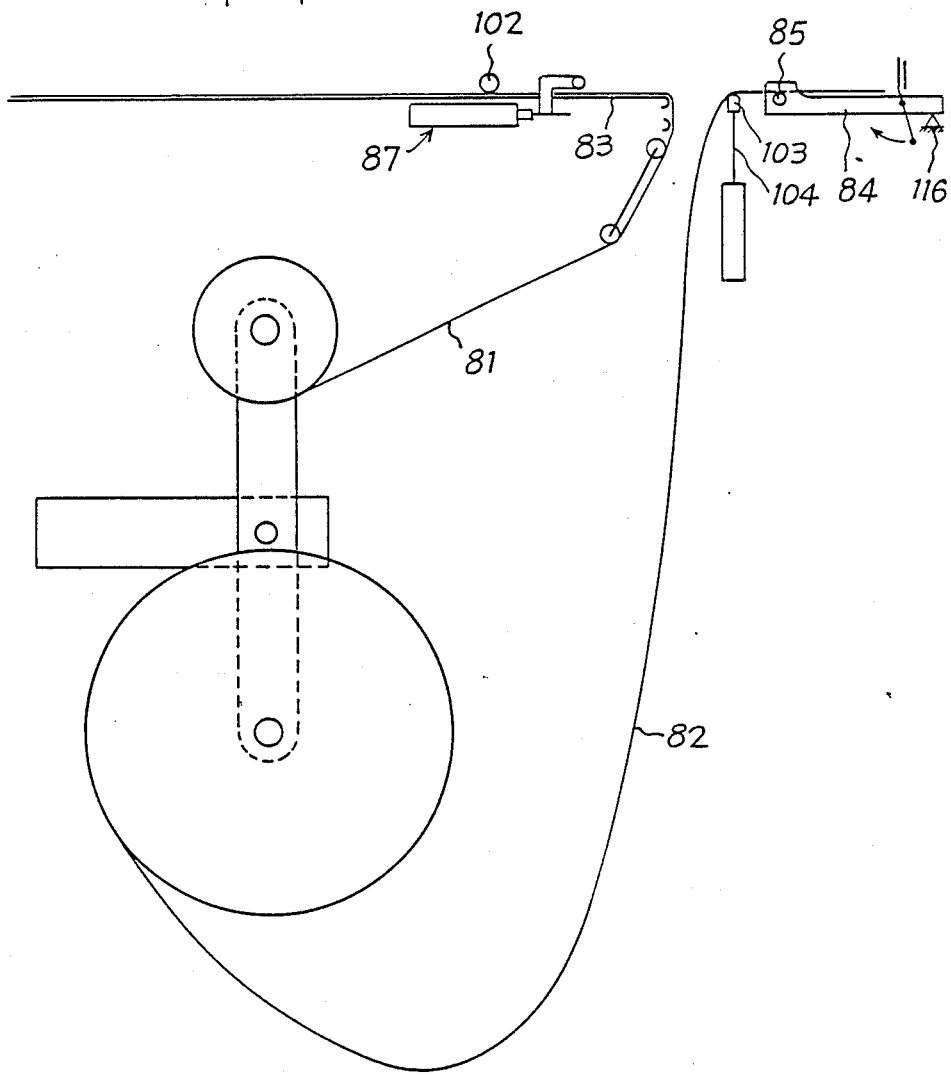
FIG. 10 is a diagrammatic elevation view of a second embodiment of the splicing mechanism, said embodiment differing from the first by modifications to the applicator lever, to the temporary support means, and to the support table.
Figure 11:
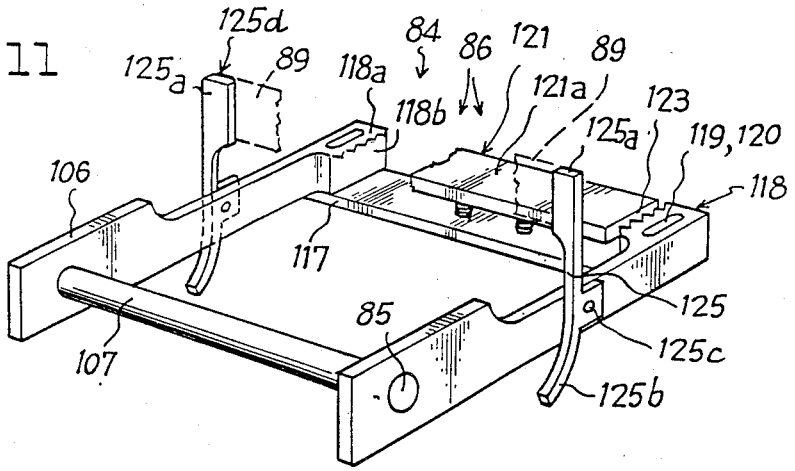
FIG. 11 is a perspective view of the second embodiment of the applicator lever shown in the tilted loading position.

The lever 84 of the splicing mechanism shown in FIG. 10 occupies a loading position analogous to that of the lever 84 shown in FIGS. 4 and 5, with the front end of the lever in the horizontal position being to the right of its hinge axis 85 and resting on an abutment 116. The support bar 103 of the lever 84 and its control rod 104 are then in the low position in which said bar 103 is at the same level as the hinge axis 85 and the uppermost face of the support table 83. FIG. 11 is a perspective view of the applicator lever 84 shown occupying its loading position as in FIG. 10.

As in the first embodiment, the lever 84 comprises two side bars 106 connected at their upstream end by the connection tube 107 and at their front end by a transverse sill 117 fixed on the uppermost faces 106*a* of said side bars 106. The front ends of the side bars 106 extend towards the opposite side bar in the form of blocks 118 whose horizontal cross-sections are substantially rectangular and each of which includes a housing 119 in its bottom face 118*a* for receiving a permanent magnet 120 which is fixed in said housing 119, e.g. by gluing. A transverse bearing plate 120 is disposed in the empty space between the inside faces 118*b* of the front blocks 118, and is connected to the transverse sill 117 by a plurality of helical springs 122 such that in the absence of any pressure exerted on the bottom face 121*a* of said plate 121, said bottom face 121*a* comes into alignment with the bottom faces 118*a* of the blocks 118. On the inside, i.e. facing the other side bar 106 or other block 118, each bottom face 118*a* is extended on its longitudinal edge by a sawtooth cutting edge 123 which is intended to co-operate with a similar cutting edge 124 provided on the corresponding longitudinal edge of the uppermost face of the support table 83 (see FIG. 12). The length of the longitudinal edge of each front block 118 is substantially equal to the width of the adhesive tape 89 which, in this particular case, has only one adhesive face, namely its bottom face 89*a*. A metal support plate 125, e.g. made of steel, is hinged to the inner or outer side face of each side bar 106 (see FIGS. 11 and 12) with the front portion 125*a* of the support plate being enlarged in order to overlie the bottom face 118*a* of the corresponding block 118 except for over the inside cutting edge 123 The rear end 125*b* of each support plate 125 is shaped to constitute a handle and is disposed on the opposite side of a pin 125*c* which hinges the plate 125 to the corresponding side bar 106. The uppermost face 125d of the enlarged front portion 125a of each support plate 125 is intended to receive the bottom adhesive face 89a of the adhesive tape 89. In order to facilitate placing the tape 89 on the support plates 125, the support plates are placed in a position where they extend perpendicularly to the side bars 106 (see FIG. 12). After the tape 89 has been put into place in a vertical position on the plates 125, the leading end 82a of the second strip 82 is stuck to the bottom or upstream half of the width of the adhesive tape 89 so that one-half of the tape projects beyond the transverse leading edge of the second strip 82. Naturally, in this case, the free end portion 82a of the second strip 82 passes over the cross-bar 103 and the connection tube 107 as can be seen in FIG. 10. After the leading end 82a of the second strip 82 has been fixed to the adhesive tape 89, the support plates 125 are simultaneously brought against the bottom face 118a of the front blocks 118 against which they are held in place together with the side ends of the adhesive tape 89 by the action of the permanent magnets 120.

The applicator lever 84 is then tilted towards its waiting position (see FIG. 3) and after the trailing end 81b of the first strip 81 has been cut, the lever 84 is allowed to tilt freely from its waiting position (see FIG. 6) towards the support table 83 as soon as the trailing edge (i.e. the trailing end 81b of the first strip 81) has reached the position on the table 83 in which it coincides with the transverse vertical midplane 83b of said table 83 (see FIG. 13). FIGS. 12, 13, and 15 are diagrams showing the position in which the strips 81 and 82 are spliced together on the support table 83 and also showing the applicator lever 84 immediately prior to the end portions of the adhesive tape 89 being cut laterally by co-operation between the lateral cutting edges 123 and 124 of the lever 84 and of the table 83 respectively. In order to enable the side bars 106 and their front blocks 118 to move down beneath the level of the uppermost face of the table 83, thereby applying pressure to the springs 112 and to the bearing plate 121 and simultaneously cutting the adhesive tape 89 at the longitudinal edges of the strips 81 and 82, the table 83 includes longitudinal recesses 126 level with the front blocks 118 and the side bars 106.

In this particular case, the temporary support means 86 for the adhesive tape 89 are constituted by the following elements taken together: the front blocks 118 of the side bars 106; the permanent magnets 120; the support plates 125; and the longitudinal cutting edges 123 of the front blocks 118 which co-operate with the cutting edges 124 of the table 83. As can be seen, in particular in FIGS. 13 and 15, the ends 81b and 82a of the first and second strips 81 and 82 are juxtaposed end-to-end in a common plane and are connected together by the adhesive tape 89 which is stuck astride them with equal widths of the tape being applied to each of the two ends 81b and 82a. In order to achieve this solution, the length of the travel of the trailing edge 81b of the first strip 81 from the plane 83a where the first strip 81 is cut to the vertical midplane 83b of the table 83 is equal to a single advance step of the first strip 81 or to an integer multiple of advance steps; Further, the distance between the midplane 83b and the hinge axis 85 of the applicator lever 84 is such that the midplane separates the front portions 125a of the support plates 125 into two equal halves when the plates are placed level with the support table.

A third embodiment of the splicing mechanism shown in FIGS. 16 to 20 is more particularly suitable for splicing together the touching ends of two composite strips 127 and 128 each constituted by two individual strips 129 & 130 or 131 & 132 which are superposed and which can be peeled apart from each other (see FIG. 21).

The structure of the applicator lever 84 of this third embodiment is practically identical to that of the lever 84 of the second embodiment (FIGS. 11 and 12) and is not described in greater detail. However, it includes auxiliary means 133 which are associated with the pair of metal support plates 125 in a manner described below.

In order to be able not only to apply an adhesive tape 89 against the uppermost faces of the touching ends of the first and second composite strips 127 and 128, but also to be able to apply a second adhesive tape 134 on the bottom faces of the touching ends of said composite strips 127 and 128, the working table 83 has a stepped transverse hollow 135 serving to receive a displaceable transverse anvil 136 associated with a support bow 137 which serves as fixing and support means for the ends of the second adhesive tape 134. The bow 137 is shaped like a violin bow and comprises a support stick 137a extending parallel to the front face 136a of the anvil 136, said stick being longer than the anvil 136 and extending beyond its side edges, and is pivotally mounted on the longitudinal front or downstream face 136a of said anvil 136 by means of a hinge 138, and carries a support and fixing tongue 137b at each of its ends, said tongues extending over the entire width of the anvil 136 when they occupy the horizontal position in which they extend slightly below the level of the uppermost face of the anvil 136 (see FIG. 20). In order to facilitate the placing the second adhesive tape 134 on the tongues 137b of the bow 137, the bow may be removed laterally together with the anvil 136 from the housing 135 provided in the table 83 and may be pivoted upwardly about a horizontal hinge axis 138 so that outside said housing 135, the pair of tongues 137b can take up the vertical position shown in FIG. 18. When the tongues 137b are in this position, the adhesive face of the second adhesive tape 134 is glued against the vertical righthand or lower faces of said tongues 137b such that when the tongues 137b are in the horizontal position (see FIGS. 17 and 20) the tape 134 is applied and stretched over the uppermost face of the anvil 136 with its adhesive face facing upwards. The side edges of the uppermost face of the anvil 136 may be provided with cutting blades 124 as in the second embodiment. When the bow 137 is in the horizontal position, the assembly comprising the anvil 136 and the bow 137 fitted with the second tape 134 can be reinserted in the housing 135 which is covered with a portion of the first composite tape 127.

The auxiliary means 133 associated with the pair of support plates 125 on the applicator lever 84 comprise a transverse reference cross-bar 138 disposed in front of the front or bottom faces of said plates 125 level with the hinges 125c thereof so as to be fixed to the two side bars 106 of said lever 84. In addition to the reference cross-bar 138, the auxiliary means 133 include a first magnetized cutting jig 139 of rectangular cross-section whose bottom small face 139a rests against the reference cross-bar 138 with a length of the second composite strip 128 being clamped between said cross-bar 138 and said first jig 139. The height of this first magnetized jig 139 whose vertical rear face 139c is pressed against the plates 125 in the vertical position is such that the uppermost small face 139*b* thereof is at the same level as the horizontal plane 140 between the two half-widths 89*c* and 89*d* of the tape 89 stuck in the vertical position to the uppermost or rear faces of the support plates 125 when in the vertical position (FIG. 19).

The end portion of the second composite strip 128 is delaminated so as to separate the ends of the individual strips 131 and 132 of said second composite strip 128 from each other, which composite strip is partially stuck to the tape 89 by the uppermost or rear face of individual strip 131. The other individual strip 132 of the composite strip 128 is folded forwardly so as to be applied against the uppermost face 139*b* of the first removable jig 139, and it is clamped in this position by means of a removable magnetized clamping bar 141 pressed against the front vertical face 139*d* of the jig 139 with the free end of said other individual strip 132 being interposed therebetween. The uppermost face 139*b* has two cutting and reference grooves 142 and 143, with the first groove 142 being situated close to the rear vertical face 139*c* of the jig and serving to cut the second individual strip 132 which then projects only very little beyond the horizontal plane 140. Thereafter, the free end of the first individual strip 131 is folded over the jig 139 and clamped against the vertical front face 139*d* thereof by means of the removable bar 141 and is cut by means of a blade 144 using the second reference groove 143 situated close to the front face 139*d* of said jig 139. The length of the free end of the first individual strip 131, which free end protects upwardly beyond the plane 140 and is stuck to the tape 89, lies between one seventh and one fourth of the width of said tape 89.

After the jig 139 and the clamping bar 141 have been removed, the support plates 125 with the adhesive tape 89 and the end of the second composite strip 128 are folded down against the front end 118 of the side bars 106 where they are held in place by the permanent magnets 120 (FIGS. 11 and 12). The assembly constituted by the applicator lever 84, the adhesive tape 89, and the leading end of the second composite strip is tilted to the waiting position in which the front end of the applicator lever 84 extends over the support table 83 whose housing 134 has previously received the assembly constituted by the removable anvil 136, the bow 137, and the second adhesive tape 134 (see FIG. 20) When the trailing end 127*b* of the first composite strip 127 comes over the anvil 136 and coincides with the transverse midplane 83*b* of the support table, about which midplane equal half widths ML of the second or lower tape 134 are placed.

The fourth embodiment of the splicing mechanism which is also intended for splicing two composite strips 127 and 128 is very similar to the third embodiment except that in the fourth embodiment the leading end of the first upper individual strip 131 does not project beyond the leading end of the second or lower individual strip 132 in the second composite strip 128. In other words, the trailing and leading ends respectively of the two composite strips 127 and 128 have transverse edges in which the individual strips 129 & 130 or 131 & 132 coincide accurately (see FIG. 28) Naturally, the individual strips 129 & 130 and 131 & 132 of each of the composite strips 127 and 128 normally adhere to each other and can only be peeled apart or delaminated by applying a suitable force In this embodiment (FIGS. 22 to 27), the support table is mounted between two longitudinal side plates 145 of a frame 146 which has the pivot axis 85 of the applicator lever 84 located thereon upstream from the table 83. The structure of the lever 84 is identical to that shown in FIGS. 11 and 12. The frame 146 also includes a support bearing 147 at its upstream end for supporting the support shaft 148 of a reel 96 from which the first composite strip 127 is paid out step-by-step. Further upstream from the frame 146 and at a higher level, there is a support bearing 149 for the reel 97 of the second composite strip 128, said second bearing 149 being associated with a pivoting lever 150 enabling a reel to be transferred from the second support bearing 149 to the first bearing 147 of the frame 146. The cutting unit 87 disposed upstream from the hinge axis 85 of the applicator lever 84 and downstream from the first bearing 147 is constituted in this case by a guillotine 151 whose counterblade 152 is disposed above the path of the first composite strip 127 and is removable.

In this case, the support table 83 includes a supporting cross-member 153 extending perpendicularly to the longitudinal side plates 145 of the frame 146 and having a channel section cross-section which is open upwardly and whose bottom 154 is provided with a fixed anvil 155 and whose vertical walls 156 are disposed at a certain distance from the upstream and downstream faces of the anvil 155 and have their free ends 156*a* extending above the uppermost face 155*a* of the anvil. The uppermost faces 155*a* of the support cross-member 153 serve to guide the composite strip 127 and to maintain the bottom face thereof at a small distance from the anvil 155. Guide grooves 157 are provided in the vertical walls 156 of the support cross-member 153 for guiding a removable supporting bow 158 which is similar in structure to that of the third embodiment, but which is independent from the anvil 155.

In this case, the removable bow 158 includes a grasping handle 158*d* extending its support stick 158*a* beyond the first fixing tongue 158*b* which extends perpendicularly to said stick 158*a*. The second fixing tongue 158*c* provided at the other end of the stick 158*a* furthest from the end connected to the handle 158*d* is slightly longer than the first tongue 158*b*, thereby enabling its free ends 158*c*′ and 158*c*″ to engage in the guide grooves 156 of the cross-member 153. These guide grooves 157 extend initially horizontally and thereafter they curve downwardly close to the longitudinal plate 145 furthest from the plate having a lateral opening through which the removable bow 158 is inserted, said opening matching the cross-section of the supporting cross-member 153. An adhesive tape 134 has its uppermost face glued to the bottom faces of the tongues 158*b* and 158*c* such that the sticky face of the adhesive tape 134 faces upwardly After the bow 158 has been inserted in the supporting cross-member 153, the adhesive tape 134 rests against the fixed anvil 155 and is under a small amount of tension (see FIG. 25) ready for splicing.

The leading end of the second composite strip 128 is fixed to the applicator lever 84 in the manner described with reference to the second embodiment and such that the uppermost half width 89*c* of the adhesive tape 89 remains free (see FIG. 26).

The applicator lever 84 together with the leading end of the second composite strip 128 is then placed in the waiting position above the support table 83, and as soon as the transverse edge of the trailing end 127*b* of the first composite strip 127 comes over the fixed anvil 155 and coincides with the transverse midplane 83*b* of the support table 83, and thus of said anvil 155 (FIG. 27), the front end of the applicator lever 84 falls onto the anvil 155, thereby connecting the two composite strips 127 and 128 and cutting off the ends of the adhesive tapes 89 and 134 which extend beyond the longitudinal edges of said strips 125 and 128.

I claim:

1. A method for changing liquid or semi-liquid products for dispensing into a succession of thermoplastic receptacles bearing respective decorative and informative elements in the form of labels, wherein a first series of said labels is fixed on a first series of thermoplastic receptacles into which a first product is dispensed, and a second series of said labels is fixed on a second series of receptacles into which a second product is dispensed, said method being carried out in a packaging installation comprising a station supporting a reel of thermoplastic strip from which the receptacles are to be formed, a heating station for rasing the thermoplastic strip to thermoforming temperature, a thermoforming station having a transverse midplane, a filling station including a metering dispenser for the product connected to at least one storage tank by feed ducts, said metering dispenser having ejection nozzles comprising a transverse midplane, a receptacle closing station having a transverse midplane and associated with at least one reel for a strip of tops to be sealed to the edges of filled receptacles, a cutting station for separating receptacles from their connection with the thermoplastic strip, a pulling or advancing station for advancing the thermoplastic strip by steps of predetermined length, a decorating station including at least one reel of a first master strip having a trailing end and a second master strip having a leading end from which master strip individual strips of decorative labels are cut longitudinally, said master strip and individual strip being advanced by steps of predetermined length, a first splicing mechanism for said master strip including a first knife and a prewinding and transverse cutting block in which said individual strips of decorative labels are cut transversely into individual labels;

said method comprising the steps of determining a minimum buffer volume of the first product corresponding to the sum of portions of the first product still to be dispensed into the first series of said receptacles prior to the replacement of said first series of receptacles in the filling station by a second series of said receptacles, cutting the first master strip in the decorating station transversely at a distance from the filling station corresponding to the length of the first master strip which will be applied to the receptacles of the first series thereof receiving the last portions of product from the minimum buffer volume of first product; and connecting the trailing end of the cut length of first master strip to the leading end of said second master strip, whereby a second product is inserted into the feed duct upstream from the metering dispenser in such a manner as to cause said second product to replace said first product in the minimum buffer volume.

2. A method according to claim 1, wherein said minimum buffer volume consists in the volume of said first product contained in the metering dispenser, in a buffer tank inserted in the ducts between said storage tank and said metering dispenser and in the ducts connecting said metering dispenser to said buffer tank.

3. A method according to claim 1, wherein said minimum buffer volume consists in the volume of said first product contained in the metering dispenser, in a product mixer inserted in the ducts between said storage tank and said metering dispenser and in the ducts connecting said metering dispenser to said product mixer.

4. A method according to claim 1, wherein two successive master strips are spliced together between two advance steps of the first strip by placing the corresponding ends of the two strips end to end by connecting said ends together by means of at least one transversely extending adhesive tape.

5. A method according to claim 1, wherein the first splicing mechanism for splicing the two master strips is disposed at a distance given as a predetermined number of advance steps $X+Y$ of the thermoplastic strip and of a master strip from the transverse midplane of the ejection nozzles of the metering dispenser, which distance or number of steps $X+Y$ corresponds to said minimum volume of a first product, said minimum volume corresponding to the portions of a first product dispensed into a predetermined number of receptacles which are thermoformed during the predetermined number of advance steps $X+Y$, wherein X is the number of advance steps of the thermoplastic strip between the transverse midplane of the thermoforming station and the transverse midplane of the ejection nozzles of the metering dispenser, and Y is the number of advance steps of master strip between the first knife of the first splicing mechanism and the prewinding and transverse cutting block.

6. A method according to claim 1, wherein a first series of tops is applied to said first series of thermoplastic receptacles and a different second series of tops is applied to said first second series of thermoplastic receptacles, said receptacle closing station which includes a first strip of tops having a trailing end and a second strip of tops having a loading end, and wherein said packaging installation further comprises a second splicing mechanism for said strips of tops including a second knife, and wherein said first top strip is cut transversely at a distance from the closing station corresponding to the length of said thermoplastic strip having been formed into the receptacles on which are applied the last labels of said first series thereof and receiving the last portions of product from the minimum buffer volume of first product, and wherein the trailing end of the cut length of said first top strip is connected to the leading end of said second top strip.

7. A method according to claim 6, wherein the master strips and the top strips are spliced simultaneously when the distance between the knife of the second splicing mechanism and the transverse midplane of the closing station is equal to $PL\times(X+Y+Z)$, wherein PL is the length of an advance step of the thermoplastic strip, X is the number of advance steps of the thermoplastic strip between the transverse midplane of the thermoforming station and the transverse midplane of the ejection nozzles of the metering dispenser, Y is the number of advance steps of master strip between the knife of the first splicing mechanism and the prewinding and transverse cutting block, and Z is the number of advance steps of the thermoplastic strip between the transverse midplane of the ejection nozzles and the transverse midplane of the closing station.

8. A method according to claim 6, wherein the top strips are spliced prior to the master strips.

9. A method according to claim 6, wherein the top strips are spliced after the master strips.

10. A method for changing liquid or semi-liquid products for dispensing into a succession of thermoplastic receptacles bearing respective decorative and informative elements in the form of tops, wherein a first series of tops is fixed on a first series of thermoplastic receptacles into which a first product is dispensed, and a second series of tops is fixed on a second series of receptacles into which a second product is dispensed, said method being carried out in a packaging installation comprising a station supporting a reel of thermoplastic strip from which the receptacles are to be formed, a heating station for raising the thermoplastic strip to thermoforming temperature, a thermoforming station having a transverse midplane, a filling station including a metering dispenser for the product, connected to at least one storage tank by feed ducts, said metering dispenser having ejection nozzles comprising a transverse midplane, a receptacle closing station having a transverse midplane and associated with at least one reel for a strip of tops to be sealed to the edges of filled receptacles, said receptacles closing station including a first strip of tops having a trailing end and a second strip of tops having a leading end, a cutting station for separating receptacles from their connections with the thermoplastic strip, a pulling or advancing station for advancing the thermoplastic strip by steps of predetermined length, a splicing mechanism for said strips of tops including a knife and a prewinding and transverse cutting block;

said method comprising the steps of determining a minimum buffer volume of the first product, corresponding to the sum of portions of the first product still to be dispensed into the first series of said receptacles prior to the replacement of said first series of receptacles in the filling station by a second series of said receptacles, cutting the first top strip transversely at a distance from the closing station corresponding to the length of the first top strip which will be applied to the receptacles of the first series thereof receiving the last portions of product from the minimum buffer volume of the first product, and connecting the trailing end of the cut length of top strip to the leading end of said second top strip, and wherein said second product is introduced into the feed duct upstream from the metering dispenser in such a manner as to cause said second product to replace said first product in the minimum buffer volume when the length of the end portion of said first top strip is equal to $PL \times (X+Y+Z)$, wherein PL is the length of an advance step of the thermoplastic strip, X is the number of advance steps of the thermoplastic strip between the transverse midplane of the thermoforming station and the transverse midplane of the ejection nozzles of the metering dispenser, Y is the number of advance steps of master strip between the knife of the first splicing mechanism and the prewinding and traneverse cutting block, and Z is the number of advance steps of the thermoplastic strip between transverse midplane of the ejection nozzles and the transverse midplane of the closing station.

11. A method according to claim 10, wherein said minimum buffer volume comprises the volume of said first product contained in the metering dispenser, in a buffer tank inserted in the ducts between said storage tank and said metering dispenser and in the ducts connecting said metering dispenser to said buffer tank.

12. A method according to claim 11, wherein two successive top strips are spliced together between two advance steps of the first strip by placing the corresponding ends of the two strips end to end and by connecting said ends together by means of at least one transversely extending adhesive tape.

13. A method according to claim 11, wherein two successive top strips are spliced together between two advance steps of the first strip by placing the corresponding ends of the two strips end to end and by connecting said ends together by means of at least one transversely extending adhesive tape.

14. A method according to claim 10, wherein said minimum buffer volume comprises the volume of said first product contained in the metering dispenser, in a product mixer inserted in the ducts between said storage tank and said metering dispenser and in the ducts connecting said metering dispenser to said product mixer.

15. A method according to claim 14, wherein two top strips are spliced together by disposing the leading end of the second strip onto the trailing end of the first strip and by connecting the two ends together by means of at least one transversely extending adhesive tape.

16. A method according to claim 14, wherein two top strips are spliced together by disposing the leading end of the second strip onto the trailing end of the first strip and by connecting the two ends together by means of at least one transversely extending adhesive tape.

17. A method according to claim 10, wherein two successive top strips are spliced together between two advance step of the first strip by placing the corresponding ends of the two strips end to end and by connecting said ends together by means of at least one transversely extending adhesive tape.

18. A method according to claim 10 wherein two top strips are spliced together by disposing the leading end of the second strip onto the trailing end of the first strip and by connecting the two ends together by means of at least one transversely extending adhesive tape.

19. A mechanism for splicing the trailing end of a first strip to the leading end of a second strip, comprising a fixed lower support table having a transverse midplane and serving temporarily as a bearing surface for the two strip ends to be spliced together, a cutting unit for transversely cutting said first strip and located beneath said support table so as to cut said first strip in a transverse cutting plane upstream from said support table, an applicator lever having one end hinged about a horizontal axis upstream from said support table and another end including a temporary support means for a transverse adhesive tape, said applicator lever being mounted tiltable from a waiting position over said support table, either towards said support table or towards a loading position at a location distant from said support table and having a bearing plate at the end thereof opposite said hinged end, said adhesive tape having one adhesive face, having two lateral ends adhesively fixed to said temporary support means and two positions, one of which being transversely and adhesively fixed to the leading end of said second strip and the other portion being held free until its application onto the trailing end of said first strip which is advanced stepwise in steps of predetermined length.

20. A mechanism according to claim 19 wherein the transverse cuttiing plane of the cutting unit for cutting the first strip is provided at a distance from the transverse midplane of said support table equal to a positive integer multiple of the full advance step of said first strip.

21. A mechanism according to claim 19, wherein the transverse cutting plane of the cutting unit for cutting the first strip is provided at a distance from the transverse midplane of said support table equal to a positive integer multiple of the full advance step of said first strip minus one half the width of the adhesive tape.

22. A mechanism according to claim 19, wherein said applicator lever comprises side bars the rear ends of which are joined by a connection tube comprising said horizontal axis and at their front ends by a transverse sill, and wherein said temporary support means for the adhesive tape includes front blocks on the free end of the applicator lever, said blocks having inner sides and terminating said side bars, permanent magnets received in said front blocks, a pair of support plates hinged on the side bars for receiving the lateral ends of the adhesive tape, longitudinal cutting edges provided on the inner sides of said blocks and said bearing plate disposed between said front blocks and connected to said transverse sill by a plurality of helical springs.

23. A mechanism according to claim 19, wherein said support table includes longitudinal recesses level with said front blocks and said side bars, and lateral cutting edges cooperating with the cutting edges of said front blocks.

24. A mechanism according to claim 19, wherein the support table includes a transverse housing and a removable anvil located in said housing, said anvil being provided with a pivotable bow for supporting a second adhesive tape.

25. A mechanism according to claim 19, wherein the support table includes a supporting cross-member having a bottom and vertical walls with horizontally extending guide grooves provided herein, an anvil fixed on said bottom, and a removable bow for supporting a second adhesive tape and engageable is said guide grooves.

26. A mechanism for splicing the trailing end of a first strip to the leading end of a second strip, comprising a fixed lower support table having a transverse midplane and serving temporarily as a bearing surface for the two strip ends to be spliced together, a cutting unit for transversely cutting said first strip end located beneath said support table, so as to cut said first strip in a transverse cutting plane upstream from said support table, an applicator lever, having one end hinged about a horizontal axis upstream from said support table and another end including a temporary support means for a transverse adhesive tape, said applicator lever being mounted tiltable from a waiting position over said support table either towards said support table or towards a loading position at a location distant from said support table, said temporary support means for the adhesive tape comprising a bar having a front face and a bottom face and constituting a front cross-bar of the applicator lever, a permanent magnet received in said cross-bar, a metal hinge fixed to said cross-bar and having a moving plate attracted by said magnet so as to clamp the leading end of said second strip against the front face of said cross-bar, and said adhesive tape having two adhesive faces, one of said faces being adhesively fixed to said leading end of said second strip in front of said bottom face of said cross-bar and the other adhesive being applied to the trailing end of said twist strip which is advanced stepwise in steps of predetermined length.

* * * * *